US009475114B2

(12) United States Patent
Kurosawa et al.

(10) Patent No.: US 9,475,114 B2
(45) Date of Patent: Oct. 25, 2016

(54) CONTINUOUS CASTING METHOD FOR INGOT PRODUCED FROM TITANIUM OR TITANIUM ALLOY

(71) Applicant: Kobe Steel, Ltd., Hyogo (JP)

(72) Inventors: Eisuke Kurosawa, Kobe (JP); Takehiro Nakaoka, Kobe (JP); Kazuyuki Tsutsumi, Kobe (JP); Hideto Oyama, Takasago (JP); Hidetaka Kanahashi, Takasago (JP); Hitoshi Ishida, Kobe (JP); Daiki Takahashi, Kobe (JP); Daisuke Matsuwaka, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/437,250

(22) PCT Filed: Jan. 10, 2014

(86) PCT No.: PCT/JP2014/050358

§ 371 (c)(1),
(2) Date: Apr. 21, 2015

(87) PCT Pub. No.: WO2014/109399

PCT Pub. Date: Jul. 17, 2014

(65) Prior Publication Data

US 2015/0273573 A1 Oct. 1, 2015

(30) Foreign Application Priority Data

Jan. 11, 2013 (JP) ..... 2013-003916

(51) Int. Cl.
*B22D 11/20* (2006.01)
*B22D 11/22* (2006.01)

(Continued)

(52) U.S. Cl.
CPC ..... *B22D 11/001* (2013.01); *B22D 11/041* (2013.01); *B22D 11/055* (2013.01); *B22D11/188* (2013.01); *B22D 11/207* (2013.01); *B22D 11/22* (2013.01); *B22D 21/022* (2013.01); *B22D 23/10* (2013.01)

(58) Field of Classification Search
CPC . B22D 11/055; B22D 11/001; B22D 11/041; B22D 11/022
USPC ..... 164/443, 469, 485, 508
See application file for complete search history.

(56) References Cited

U.S. PATENT DOCUMENTS 6,561,259 B2 * 5/2003 Spadafora ..... B22D 11/001 164/437
2005/0115695 A1 * 6/2005 Mangler ..... B22D 11/055 164/443

(Continued)

FOREIGN PATENT DOCUMENTS

CN 1318164 C 5/2007
JP H03-52747 A 3/1991

(Continued)

OTHER PUBLICATIONS

PTO translation of JP H03-052747, Oct. 2015.*

(Continued)

*Primary Examiner* — Kevin E Yoon
(74) *Attorney, Agent, or Firm* — Studebaker & Brackett PC

(57) ABSTRACT

By controlling the temperature ($T_S$) of a surface portion (11*a*) of an ingot (11) in a contact region (16) between a mold (2) and the ingot (11) and/or a passing heat flux (q) from the surface portion (11*a*) of the ingot (11) to the mold (2) in the contact region (16), the thickness (D) in the contact region (16) of a solidified shell (13) obtained by the solidification of molten metal (12) is brought into a predetermined range. Consequently, an ingot having a good casting surface state can be cast.

5 Claims, 10 Drawing Sheets

(51) Int. Cl.

| | |
|---|---|
| ***B22D 11/00*** | (2006.01) |
| ***B22D 11/041*** | (2006.01) |
| ***B22D 11/055*** | (2006.01) |
| ***B22D 21/02*** | (2006.01) |
| ***B22D 11/18*** | (2006.01) |
| ***B22D 23/10*** | (2006.01) |

(56) References Cited

U.S. PATENT DOCUMENTS

| | | | |
|---|---|---|---|
| 2013/0327493 | A1 | 12/2013 | Oda et al. |
| 2014/0027024 | A1 | 1/2014 | Tatsuzawa et al. |

FOREIGN PATENT DOCUMENTS

| | | | |
|---|---|---|---|
| JP | 3077387 | B2 | 8/2000 |
| WO | 2012/115272 | A1 | 8/2012 |
| WO | 2012/144561 | A1 | 10/2012 |

OTHER PUBLICATIONS

International Search Report; PCT/JP2014/050358; Mar. 11, 2014.
Written Opinion of the International Searching Authority; PCT/JP2014/050358; Mar. 11, 2014.

* cited by examiner

CONTINUOUS CASTING METHOD FOR INGOT PRODUCED FROM TITANIUM OR TITANIUM ALLOY

TECHNICAL FIELD

The present invention relates to a continuous casting method for an ingot made of titanium or a titanium alloy in which an ingot made of titanium or a titanium alloy is continuously cast.

BACKGROUND ART

Continuous casting of an ingot has been conventionally performed by injecting metal melted by vacuum arc melting and electron beam melting into a bottomless mold and withdrawing the molten metal downward while being solidified.

Patent Document 1 discloses an automatic control method for plasma melting casting, in which titanium or a titanium alloy is melted by plasma arc melting in an inert gas atmosphere and injected into a mold for solidification. Performing plasma arc melting in an inert gas atmosphere, unlike electron beam melting in vacuum, allows casting of not only pure titanium, but also a titanium alloy.

CITATION LIST

Patent Document

Patent Document 1: Japanese Patent No. 3077387

SUMMARY OF THE INVENTION

Technical Problem

However, if a cast ingot has irregularities and flaws on casting surface, it is necessary to perform a pretreatment, such as cutting the surface, before rolling, thus causing a reduction in material utilization and an increase in number of operation processes. Therefore, it is demanded to cast an ingot without irregularities and flaws on casting surfaces.

In continuous casting of an ingot made of titanium, the surface of the ingot contacts with the surface of a mold only near a molten metal surface region (a region extending from the molten metal surface to an approximately 10-20 mm depth), where molten metal is heated by plasma arc and electron beam. In a region deeper than this contact region, the ingot undergoes thermal shrinkage, thus an air gap is generated between the ingot and the mold. Therefore, it is speculated that heat input/output conditions applying to an initial solidified portion of the molten metal near the molten metal surface region (a portion where the molten metal is initially brought into contact with the mold to be solidified) would have a great impact on properties of casting surface, and it is considered that the ingot having a good casting surface can be obtained by appropriately controlling the heat input/output conditions applying to the molten metal near the molten metal surface region.

An object of the present invention is to provide a continuous casting method for an ingot made of titanium or a titanium alloy, capable of casting the ingot having a good casting surface state.

Solution to Problem

The continuous casting method for an ingot made of titanium or a titanium alloy of the present invention is a method for continuous casting, in which an ingot made of titanium or a titanium alloy is continuously cast by injecting molten metal prepared by melting titanium or a titanium alloy into a bottomless mold and withdrawing the molten metal downward while being solidified, the method being characterized in that by controlling temperature of a surface portion of the ingot in a contact region between the mold and the ingot, and/or a passing heat flux from the surface portion of the ingot to the mold in the contact region, thickness in the contact region of a solidified shell obtained by solidifying the molten metal is brought into a predetermined range.

According to the configuration described above, the thickness of the solidified shell in the contact region is determined by at least either value of: the temperature of the surface portion of the ingot in the contact region between the mold and the ingot; or the passing heat flux from the surface portion of the ingot to the mold in the contact region. Thus, by controlling the temperature of the surface portion of the ingot in the contact region, and/or the passing heat flux from the surface portion of the ingot to the mold in the contact region, the thickness of the solidified shell in the contact region is brought into a predetermined range in which defects are not caused on the surface of the ingot. Having such control can suppress the occurrence of defects on the surface of the ingot, thus making it possible to cast the ingot having a good casting surface state.

Further, in the continuous casting method for an ingot made of titanium or a titanium alloy of the present invention, average values of the temperature $T_S$ of the surface portion of the ingot in the contact region may be controlled into the range of $800° C. < T_S < 1250° C$. According to the configuration described above, defects on the surface of the ingot can be suppressed from occurring.

Further, in the continuous casting method for an ingot made of titanium or a titanium alloy of the present invention, average values of the passing heat flux q from the surface portion of the ingot to the mold in the contact region may be controlled into the range of $5\ MW/m^2 < q < 7.5\ MW/m^2$. According to the configuration described above, defects on the surface of the ingot can be suppressed from occurring.

Further, in the continuous casting method for an ingot made of titanium or a titanium alloy of the present invention, the thickness D of the solidified shell in the contact region may be set to the range of $0.4\ mm < D < 4\ mm$. According to the configuration described above, there can be suppressed a "tearing-off defect", where the surface of the solidified shell is torn off due to lack of strength by not having the sufficient thickness of the solidified shell, and a "molten metal-covering defect", where the solidified shell that has been grown (thickened) is covered with the molten metal.

Further, in the continuous casting method for an ingot made of titanium or a titanium alloy of the present invention, the molten metal may be the titanium or the titanium alloy melted by cold hearth melting and injected into the mold. The cold hearth melting may be plasma arc melting. According to the configuration described above, it is possible to cast not only pure titanium, but also a titanium alloy. Here, the cold hearth melting is the superordinate concept for melting methods including plasma arc melting and electron beam melting as examples.

Effect of the Invention

According to the continuous casting method for an ingot made of titanium or a titanium alloy of the present invention, by setting the thickness of the solidified shell in the contact region within a predetermined range in which defects are not caused on the surface of the ingot, the defects on the surface of the ingot can be suppressed from occurring, thus allowing to cast the ingot having a good casting surface state.

DESCRIPTION OF EMBODIMENTS

Hereinafter, preferred embodiments of the present invention will be described with reference to the drawings. In the following descriptions, explanation is made on the case in which titanium or a titanium alloy is subjected to plasma arc melting.

(Configuration of Continuous Casting Apparatus)

Figure 1:
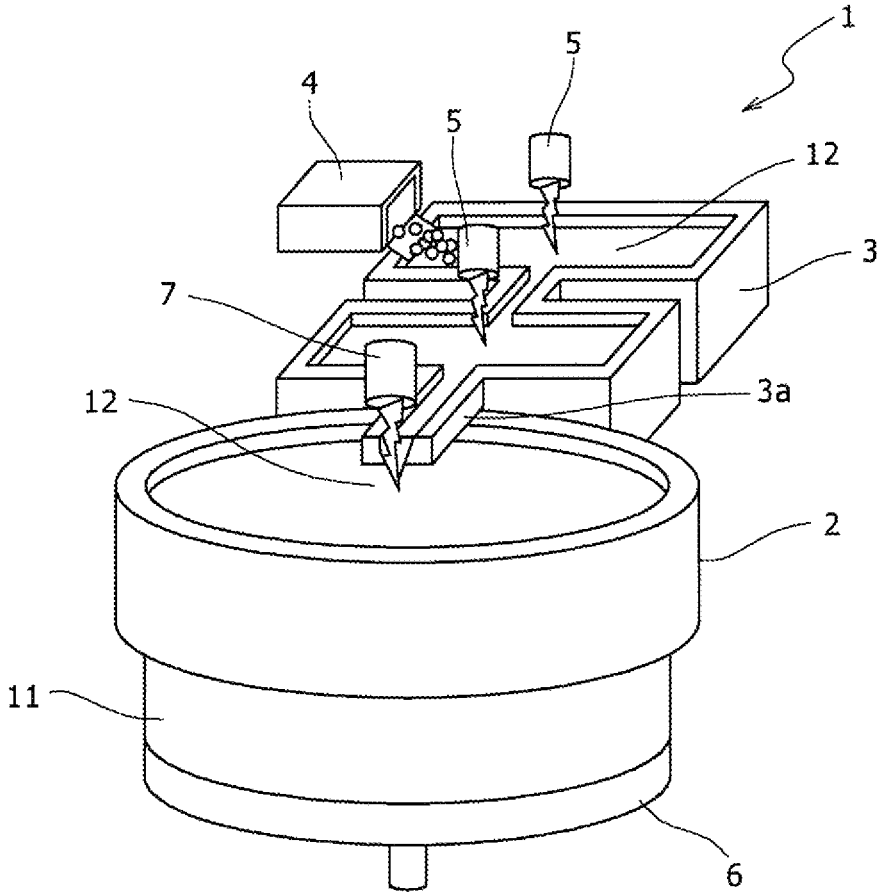
FIG. 1 is a perspective view of a continuous casting apparatus.
Figure 2:
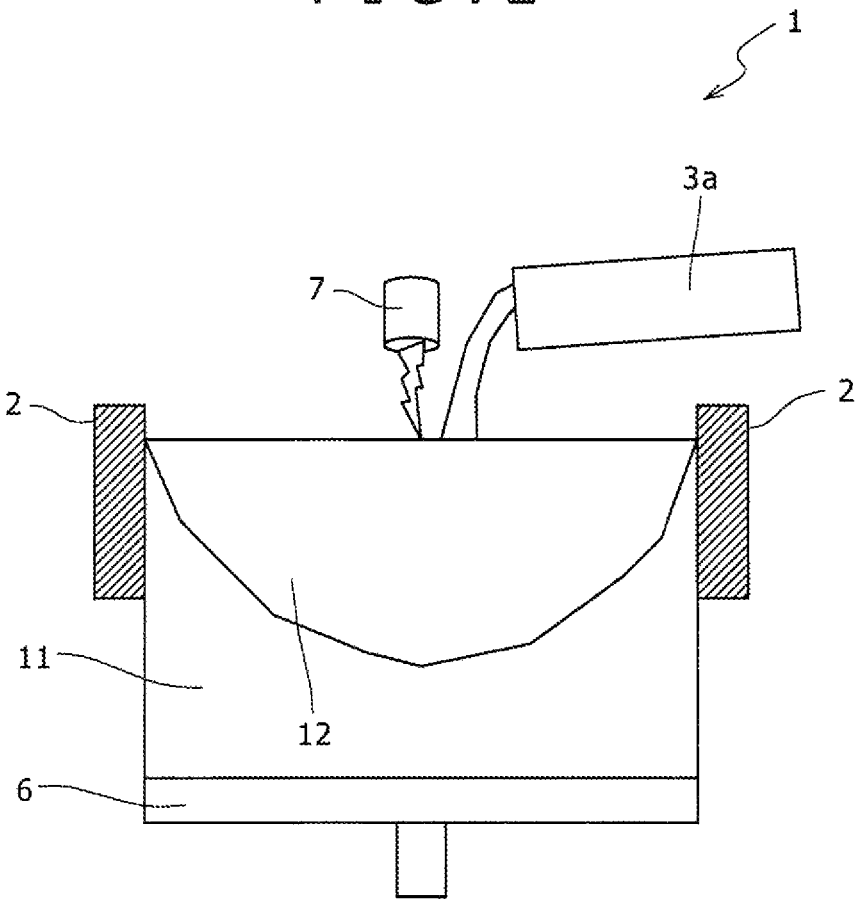
FIG. 2 is a cross-section view of a continuous casting apparatus.

In a continuous casting method for an ingot made of titanium or a titanium alloy of the present embodiment, by injecting molten metal of titanium or a titanium alloy melted by plasma arc melting into a bottomless mold and withdrawing the molten metal downward while being solidified, an ingot made of titanium or a titanium alloy is continuously cast. A continuous casting apparatus 1 for an ingot made of titanium or a titanium alloy in the continuous casting method, as shown in FIG. 1 as a perspective view and in FIG. 2 as a cross-section view, includes a mold 2, a cold hearth 3, a raw material charging apparatus 4, a plasma torch 5, a starting block 6, and a plasma torch 7. The continuous casting apparatus 1 is surrounded by an inert gas atmosphere comprising argon gas, helium gas, and the like.

The raw material charging device 4 supplies raw materials of titanium or a titanium alloy, such as sponge titanium, scrap and the like, into the cold hearth 3. The plasma torch 5 is disposed above the cold hearth 3 and used to melt the raw materials within the cold hearth 3 by generating plasma arcs. The cold hearth 3 injects molten metal 12 having the raw materials melted into the mold 2 through a pouring portion 3*a*. The mold 2 is made of copper and formed in a bottomless shape having a circular cross section. At least a part of a cylindrical wall portion of the mold 2 is configured so as to circulate water through the wall, thereby cooling the mold 2. The starting block 6 is movable in the up and down direction by a drive portion not illustrated, and able to close a lower side opening of the mold 2. The plasma torch 7 is disposed above the molten metal 12 within the mold 2 and used to heat the molten metal surface of the molten metal 12 injected into the mold 2 by plasma arcs.

In the above configuration, solidification of the molten metal 12 injected into the mold 2 begins from a contact surface between the molten metal 12 and the mold 2 having a water-cooling system. Then, as the starting block 6 closing the lower side opening of the mold 2 is lowered at a predetermined speed, an ingot 11 in a cylindrical shape formed by solidifying the molten metal 12 is continuously cast while being withdrawn downward from the mold.

In this configuration, it is difficult to cast an ingot made of a titanium alloy using electron beam melting in a vacuum atmosphere since trace components in the titanium alloy would evaporate. In contrast, it is possible to cast not only pure titanium, but also the titanium alloy using plasma arc melting in an inert gas atmosphere.

Further, the continuous casting apparatus 1 may include a flux loading device for applying flux in a solid phase or a liquid phase onto the molten metal surface of the molten metal 12 within the mold 2. In this configuration, it is difficult to apply the flux to the molten metal 12 within the mold 2 using the electron beam melting in a vacuum atmosphere since the flux would be scattered. In contrast, the plasma arc melting in an inert gas atmosphere has an advantage that the flux can be applied to the molten metal 12 within the mold 2.

Figure 3:
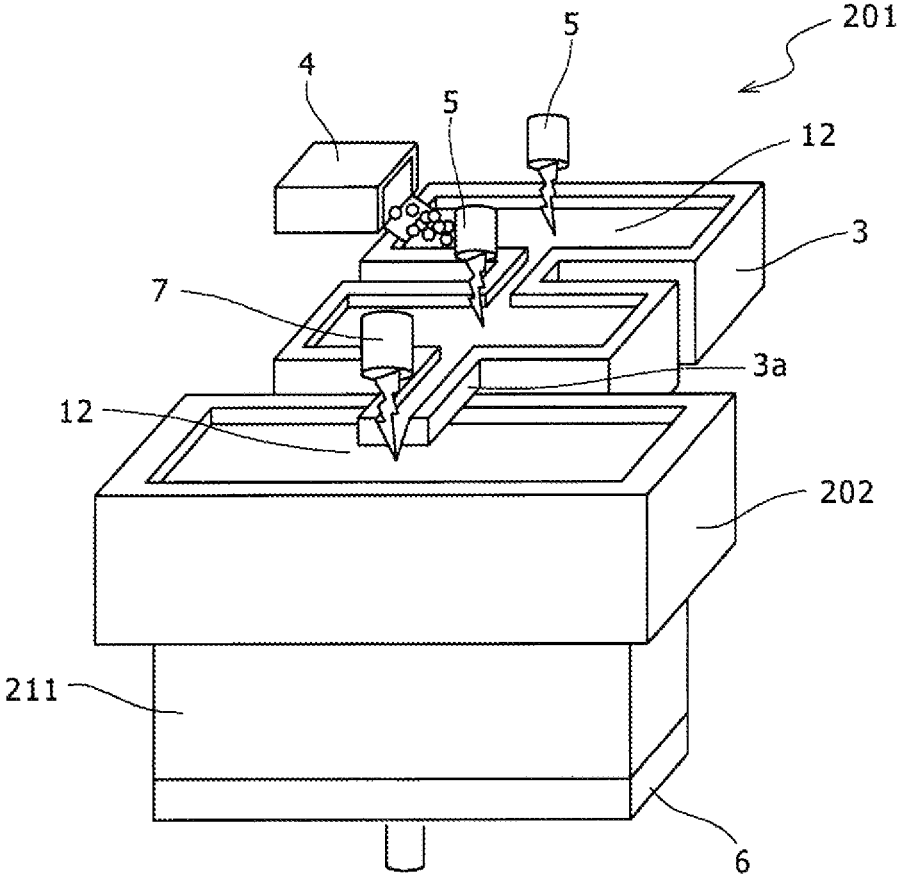
FIG. 3 is a perspective view of a continuous casting apparatus.

A continuous casting apparatus 201 performing the continuous casting method of the present embodiment may be configured to include a mold 202 having a rectangular cross section as shown in FIG. 3, and perform continuous casting of a slab 211. Hereinafter, the mold 2 having a circular cross section and the mold 202 having a rectangular cross section are grouped together and described as a mold 2, and the ingot 11 and the slab 211 are grouped together and described as an ingot 11.

(Operational Conditions)

When the ingot 11 made of titanium or a titanium alloy is produced by continuous casting, if there are irregularities or flaws on the surface of the ingot 11 (casting surface), they would cause surface defects in a rolling process, which is the next process. Thus the irregularities or the flaws on the surface of the ingot 11 must be removed before rolling by cutting or the like. However, this step would decrease the material utilization and increase the number of operation processes, thereby increasing the cost of continuous casting. As such, it is demanded to cast the ingot 11 having no irregularities or flaws on its surface.

Figure 4A:
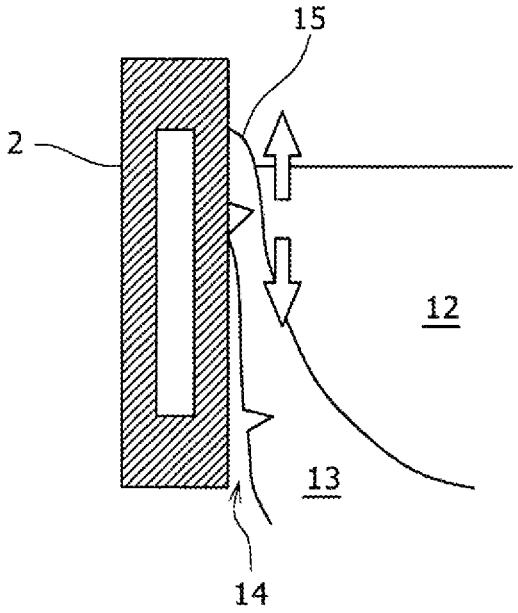
FIG. 4A is a drawing describing a causing mechanism of surface defects.
Figure 4B:
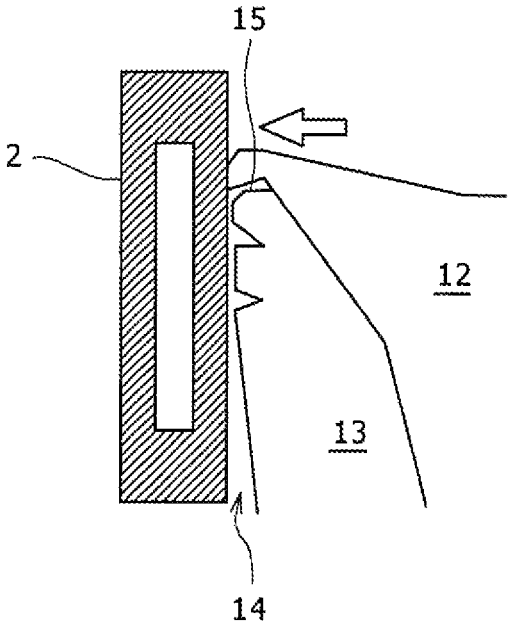
FIG. 4B is a drawing describing a causing mechanism of surface defects.

As shown in FIGS. 4A and 4B, in continuous casting of the ingot 11 made of titanium, the surface of the ingot 11 (a solidified shell 13) contacts with the surface of the mold 2 only near the molten metal surface region (the region extending from the molten metal surface to an approximately 10-20 mm depth), where molten metal 12 is heated by plasma arc or electron beam. In a region deeper than this contact region, the ingot 11 undergoes thermal shrinkage, thus an air gap 14 is generated between the ingot 11 and the mold 2. Then, as shown in FIG. 4A, if the heat input to an initial solidified portion 15 (a portion of the molten metal 12 initially brought into contact with the mold 2 to be solidified) is excessive, since the solidified shell 13 formed by solidifying the molten metal 12 becomes too thin, there occurs a "tearing-off defect", in which the surface of the solidified shell 13 is torn off due to lack of strength. On the other hand, as shown in FIG. 4B, if the heat input into the initial solidified portion 15 is too little, there occurs a "molten metal-covering defect", in which the solidified shell 13 that has been grown (thickened) is covered with the molten metal 12. Therefore, it is speculated that heat input/output conditions applying to the initial solidified portion 15 of the molten metal 12 near the molten metal surface region would have a great impact on properties of the casting surface, and it is considered that the ingot 11 having a good casting surface can be obtained by appropriately controlling the heat input/output conditions applying to the molten metal 12 near the molten metal surface region.

Figure 5:
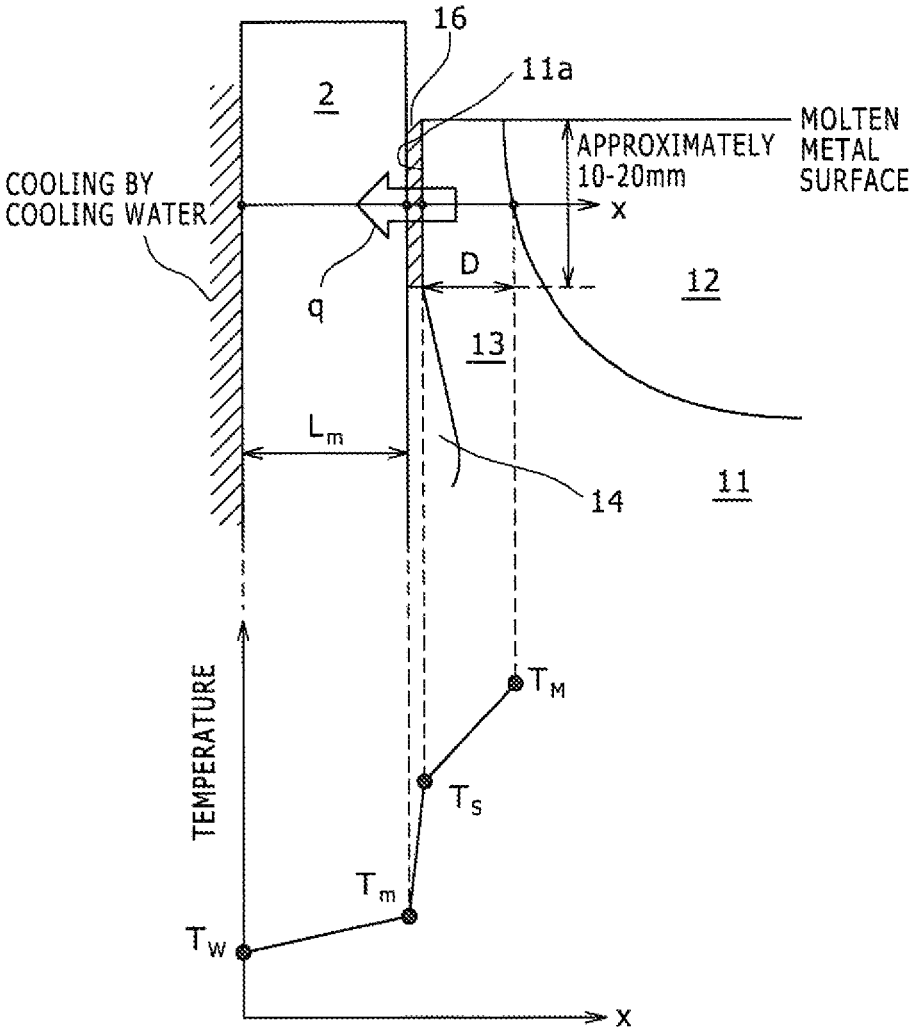
FIG. 5 is a model diagram showing temperature and a passing heat flux in a contact region.

As shown in FIG. 5, when the melting point of pure titanium (1680° C.) is represented as $T_M$, the temperature of a surface portion 11*a* of the ingot 11 as $T_S$, the surface temperature of the mold 2 as $T_m$, the temperature of cooling water circulating inside of the mold 2 as $T_W$, the thickness of the solidified shell 13 as D, the thickness of the mold 2 as $L_m$, the passing heat flux from the surface portion 11*a* of the ingot 11 to the mold 2 indicated by an arrow as q, the thermal conductivity of the solidified shell 13 as $\lambda_S$, the thermal conductivity between the mold 2 and the ingot 11 at a contact region 16 as h, and the thermal conductivity of the mold 2 as $\lambda_m$, then the passing heat flux q can be calculated by the following formula 1. It is noted that the contact region 16 refers to a region extending from the molten metal surface to an approximately 10-20 mm depth where the mold 2 and an ingot 11 are in contact, shown by hatching in the figure.

$$q=\lambda_S(T_M-T_S)/D=h(T_S-T_m)=\lambda_m(T_m-T_W)/L_m \quad \text{(Formula 1)}$$

By modifying the above formula 1, there can be obtained formula 2 indicating the relation between the thickness D of the solidified shell 13 and the temperature $T_S$ of the surface portion 11*a* of the ingot 11, and formula 3 indicating the relation between the thickness D of the solidified shell 13 and the passing heat flux q.

$$D=\lambda_S(T_M-T_S)(1/h+L_m/\lambda_m)/(T_S-T_W) \quad \text{(Formula 2)}$$

$$D=\lambda_S(T_M-T_W)/q-\lambda_S(1/h+L_m/\lambda_m) \quad \text{(Formula 3)}$$

Based on the formulas 2 and 3, formula 4 indicating the relation between the temperature $T_S$ of the surface portion 11*a* of the ingot 11, and the passing heat flux q is obtained as follows.

$$T_S=(1/h+L_m/\lambda_m)q+T_W \quad \text{(Formula 4)}$$

Based on the formulas 2 and 3 above, the thickness D of the solidified shell 13 is determined by either value of: the temperature $T_S$ of the surface portion 11*a* of the ingot 11 near the molten metal surface region of the molten metal 12 (the contact region 16 between the mold 2 and the ingot 11); or the passing heat flux q. Thus, a parameter needed to be controlled is the temperature $T_S$ of the surface portion 11*a* of the ingot 11 in the contact region 16 between the mold 2 and the ingot 11, or the passing heat flux q from the surface portion 11*a* of the ingot 11 to the mold 2 in the contact region 16 between the mold 2 and the ingot 11.

Thus, in the present embodiment, average values of the temperature $T_S$ of the surface portion 11*a* of the ingot 11 in the contact region 16 between the mold 2 and the ingot 11 are controlled into the range of 800° C.<$T_S$<1250° C. Further, average values of the passing heat flux q from the surface portion 11*a* of the ingot 11 to the mold 2 in the contact region 16 between the mold 2 and the ingot 11 are controlled into the range of 5 MW/m$^2$<q<7.5 MW/m$^2$. With such controls, the thickness D of solidified shell 13 in the contact region 16 between the mold 2 and the ingot 11 is brought within the range of 0.4 mm<D<4 mm.

Accordingly, in the present invention, the average values of the temperature $T_S$ of the surface portion 11*a* of the ingot 11 in the contact region 16 between the mold 2 and the ingot 11 and the average values of the passing heat flux q from the surface portion 11*a* of the ingot 11 to the mold 2 in the contact region 16 between the mold 2 and the ingot 11 are each controlled into the ranges described above. As described below, performing such controls can suppress the occurrence of the "tearing-off defect" and the "molten metal-covering defect". Thus, it is possible to cast the ingot 11 having a good casting surface state.

In the present embodiment, the average values of the temperature $T_S$ of the surface portion 11*a* of the ingot 11 in the contact region 16 and the average values of the passing heat flux q from the surface portion 11*a* of the ingot 11 to the mold 2 in the contact region 16 are used as a parameter needed to be controlled, however, only either of them may be used as such parameter.

Further, in the present embodiment, the parameters needed to be controlled are set for continuous casting of the ingot 11 made of pure titanium, however, this setting can be also applied to continuous casting of an ingot 11 made of a titanium alloy.

Further, it is preferred that, in the mold 202 having a rectangular cross section shown in FIG. 3, the average values of the temperature $T_S$ of the surface portion 11*a* of the ingot 11 and the average values of the passing heat flux q are set within the ranges described above along the entire inner peripheries of the mold 202 in the contact region 16. However, the average values of the temperature $T_S$ of the surface portion 11*a* of the ingot 11 and the average values of the passing heat flux q may be set within the ranges described above only along the longer-side peripheries of the mold 202 in the contact region 16. That is, since the shorter-side surfaces of the ingot 11 can be subjected to cutting work, the average values of the temperature $T_S$ of the surface portion 11*a* of the ingot 11 and the average values of the passing heat flux q may not be set within the ranges described above along the shorter-side peripheries of the mold 202 in the contact region 16. This is also the case in the lower end portion (initial portion of casting) and the upper end portion (final portion of casting) of the ingot 11, both of which can be subjected to the cutting work.

(Evaluation of Casting Surfaces)

Figure 6A:
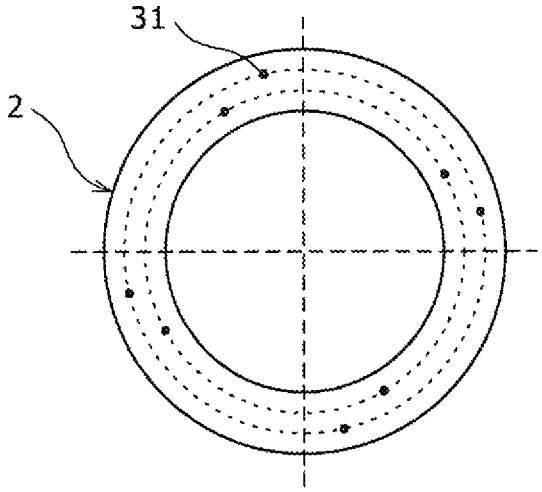
FIG. 6A is a model diagram showing a mold having a circular cross section, seen from above.
Figure 6B:
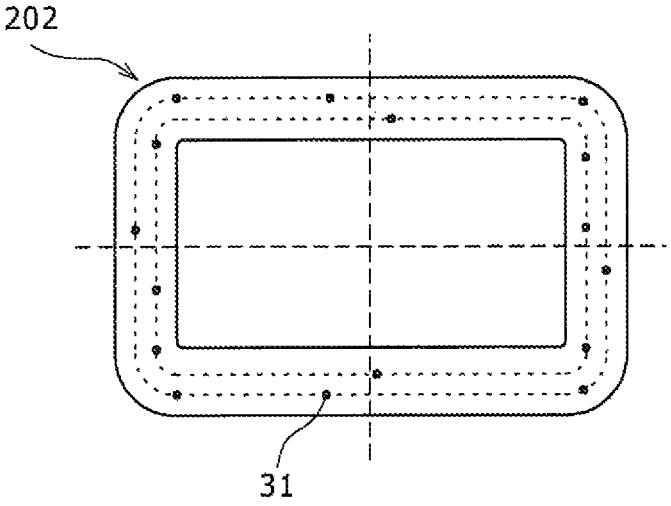
FIG. 6B is a model diagram showing a mold having a rectangular cross section, seen from above.

Next, casting surfaces are evaluated by performing continuous casting tests using pure titanium in eleven different test-operating conditions assigned as Cases 1 to 11, in which a shape of the mold, an output of the plasma torch 7, a center position of the plasma torch 7, and a withdrawal rate of the starting block 6 are used as parameters. In the tests, as shown in FIG. 6A depicting a top view of a mold 2 and in FIG. 6B depicting a top view of a mold 202, a mold 2 and mold 202 are embedded with a plurality of thermocouples 31 and used. In this configuration, all the thermocouples 31 are embedded in 5 mm depth from the molten metal surface of the molten metal 12. Table 1 shows the test-operating conditions of Cases 1 to 11.

TABLE 1

| Case | Shape of mold | Test-operating conditions: Output of plasma torch [kW] | Center position of plasma torch | Withdrawal rate [mm/min] |
|---|---|---|---|---|
| 1 | Circular Φ 81 mm | 63 | Center of mold | 10 |
| 2 | Circular Φ 81 mm | 63 | Center of mold | 10 |

TABLE 1-continued

| Case | Shape of mold | Test-operating conditions: Output of plasma torch [kW] | Center position of plasma torch | Withdrawal rate [mm/min] |
|---|---|---|---|---|
| 3 | Circular Φ 81 mm | 63 | 10 mm biased in east | 10 |
| 4 | Circular Φ 81 mm | 28 | 10 mm biased in east | 10 |
| 5 | Circular Φ 51 mm | 63 | Center of mold | 20 |
| 6 | Circular Φ 51 mm | 68 | Center of mold | 20 |
| 7 | Circular Φ 51 mm | 63 | Center of mold | 15 |
| 8 | Circular Φ 51 mm | 63 | Center of mold | 3.5 |
| 9 | Circular Φ 51 mm | 63 | Center of mold | 10 |
| 10 | Rectangular 50 × 75 mm | 63 | Center of mold | 15 |
| 11 | Rectangular 50 × 75 mm | 50 | 10 mm biased in east | 15 |

Figure 7A:
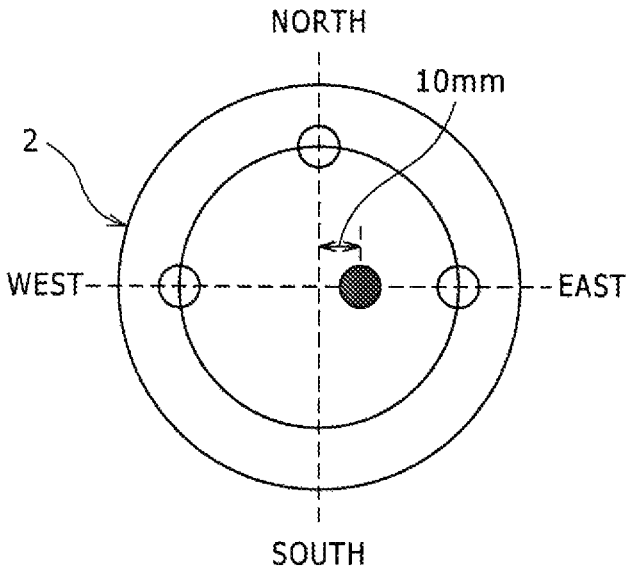
FIG. 7A is a model diagram showing a mold having a circular cross section, seen from above.
Figure 7B:
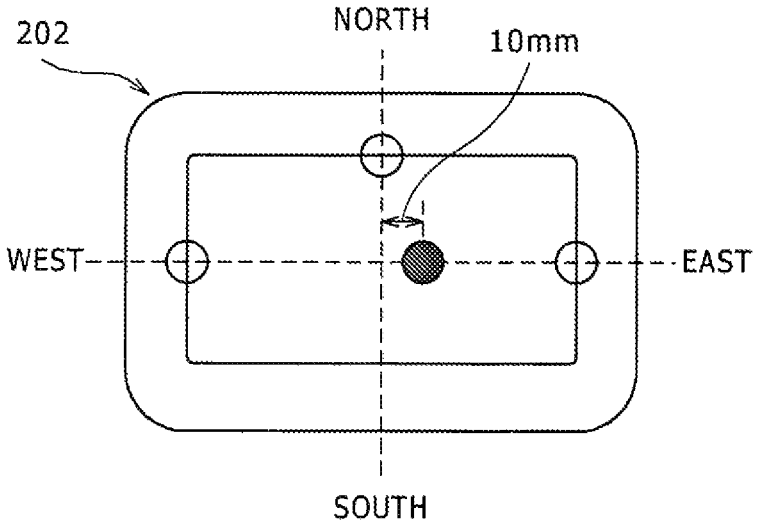
FIG. 7B is a model diagram showing a mold having a rectangular cross section, seen from above.

In Table 1, the shape of a mold being circular refers to the mold 2 having a circular cross section as shown in FIG. 1. The shape of a mold being rectangular refers to the mold 202 having a rectangular cross section as shown in FIG. 3. Further, "east" of "10 mm biased in east" etc., described in Table 1, along with "west", "south", and 'north", shown in FIGS. 7A and 7B, respectively depicting a top view of a mold 2 and a mold 202, refers to one direction of the four directions orthogonal to each other, defined in the mold 2 having a circular cross section and the mold 202 having a rectangular cross section. In the mold 202 having a rectangular cross section, the east-west direction corresponds to the long-side direction, while the south-north direction corresponds to the short-side direction perpendicular to the long-side direction. Further, "Center of mold" means that the center of the plasma torch 7 is located in the center of the mold 2 and the mold 202. Finally, "10 mm biased in east" means that, as shown in FIGS. 7A and 7B, the center of the plasma torch 7 is located at a position shifted away from the center of the mold 2 and the mold 202 by 10 mm to east.

Figure 8:
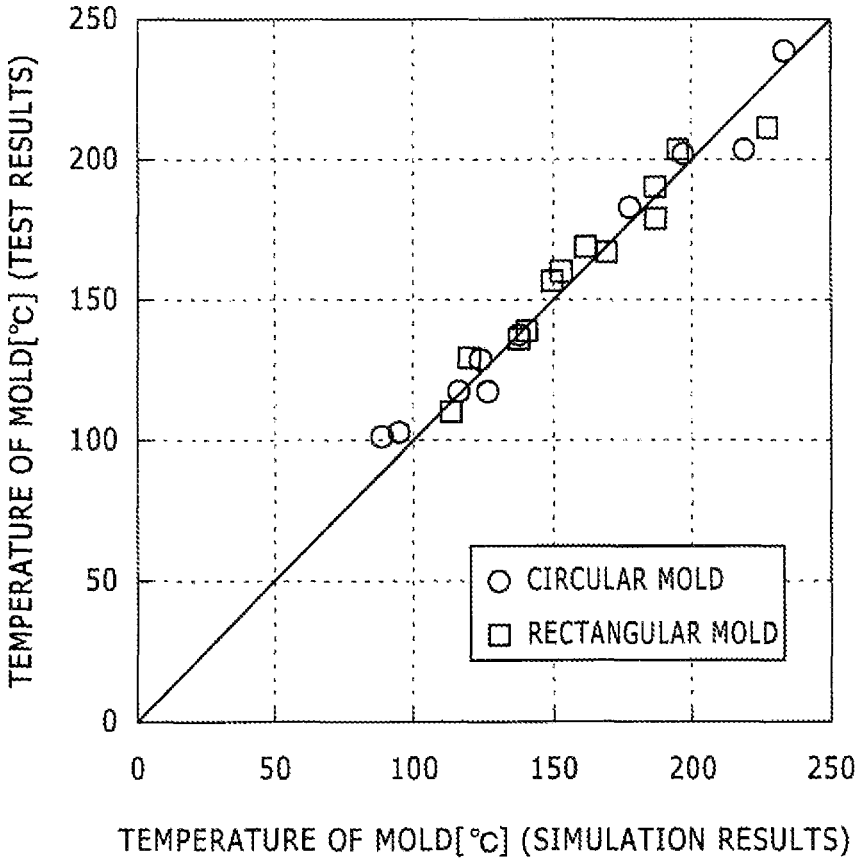
FIG. 8 is a graph showing a comparison between results of measured mold temperature obtained from continuous casting tests and simulation results of mold temperature.

Next, based on the data of the measured mold temperature obtained in the continuous casting tests, a simulation model for flow and solidification was created. FIG. 8 is a graph showing a comparison between results of the measured mold temperature obtained in the continuous casting tests and simulation results of the mold temperature. Then, thermal index values, such as temperature distribution of the ingot 11, the passing heat flux between the mold 2 and the ingot 11, and the shape of the solidified shell 13, were evaluated by the simulation. Evaluation results are shown in Table 2.

TABLE 2

| Case | Surface temperature of ingot (Average values) [° C.] West | East | North | Passing heat flux (Average values) [W/m$^2$] West | East | North | Thickness of solidified shell [mm] West | East | North | Properties of casting surface West | East | North |
|---|---|---|---|---|---|---|---|---|---|---|---|---|
| 1 | — | 984.46 | — | — | 6.06E+06 | — | — | 2.02 | — | — | Good | — |
| 2 | 963.82 | 963.82 | 971.11 | 5.72E+06 | 5.72E+06 | 5.78E+06 | 2.14 | 2.14 | 2.10 | Good | Good | Good |
| 3 | 758.52 | 1142.18 | 934.88 | 4.55E+06 | 6.63E+06 | 5.56E+06 | 3.71 | 0.96 | 2.10 | Good | Good | Good |
| 4 | 439.80 | 866.01 | 600.49 | 2.73E+06 | 5.39E+06 | 3.76E+06 | 11.61 | 3.71 | 6.60 | Covering | Good | Covering |
| 5 | — | 1256.95 | — | — | 7.55E+06 | — | — | 0.27 | — | — | Tearing-off | — |
| 6 | — | 1303.44 | — | — | 7.85E+06 | — | — | 0.00 | — | — | Tearing-off | — |
| 7 | — | 1251.20 | — | — | 7.66E+06 | — | — | 0.29 | — | — | Tearing-off | — |
| 8 | — | 1187.69 | — | — | 7.15E+06 | — | — | 0.46 | — | — | Good | — |
| 9 | — | 1243.15 | — | — | 7.52E+06 | — | — | 0.17 | — | — | Good | — |
| 10 | 1073.69 | 1073.69 | 1144.95 | 6.36E+06 | 6.36E+06 | 6.56E+06 | 1.16 | 1.16 | 1.16 | Good | Good | Good |
| 11 | 816.90 | 1021.49 | 977.67 | 4.75E+06 | 6.04E+06 | 5.55E+06 | 3.64 | 2.36 | 2.37 | Covering | Good | Good |

It is noted that "south" is presumed to be symmetrical to "north" with respect to the east-west cross section, thus data for "south" was not extracted. Further, in Cases 1 and 5 to 9, data was extracted only for "east" by performing two-dimensional axially symmetric simulation.

Figure 9:
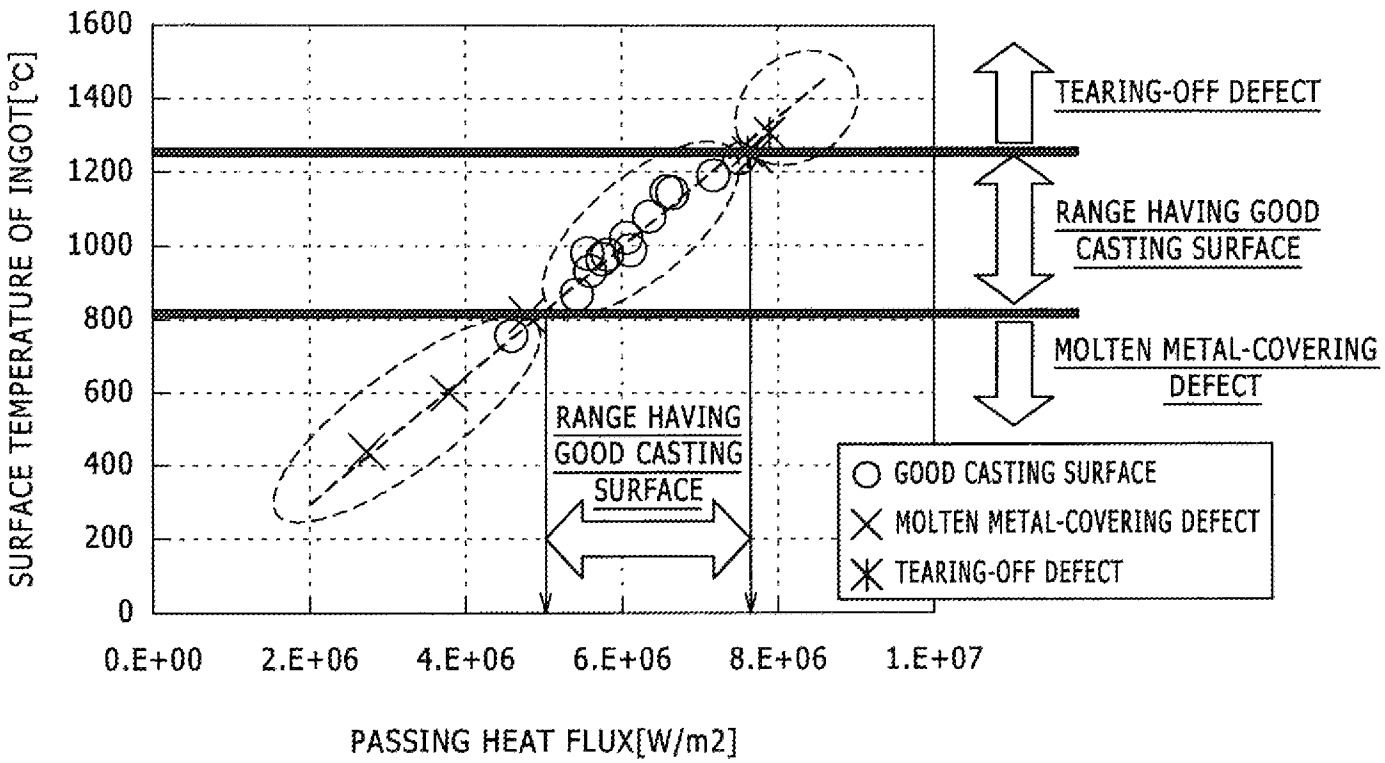
FIG. 9 is a graph showing the relation between a passing heat flux and surface temperature of an ingot.

FIG. 9 is a graph showing the relation between the passing heat flux and the surface temperature of the ingot (temperature of the surface portion of the ingot). When the average values of the surface temperature of the ingot $T_S$ in the contact region 16 between the mold 2 and the ingot 11 were 800° C. or less, the heat input into the initial solidified portion 15 was not sufficient, thus causing the "molten metal-covering defect", where the solidified shell 13 that had been grown was covered with molten metal 12. On the other hand, when the average values of the surface temperature of the ingot $T_S$ in the contact region 16 between the mold 2 and the ingot 11 were 1250° C. or more, the heat input into the initial solidified portion 15 was excessive, thus causing the "tearing-off defect", where the thin surface portion of the solidified shell 13 was torn off. The results show that the average values of the surface temperature of the ingot $T_S$ in the contact region 16 between the mold 2 and the ingot 11 are preferably controlled into the range of 800° C.$<T_S<$1250° C.

Further, when the average values of the passing heat flux q from the surface portion 11*a* of the ingot 11 to the mold 2 in the contact region 16 between the mold 2 and the ingot 11 were 5 MW/m$^2$ or less, the heat input into the initial solidified portion 15 was not sufficient, thus causing the "molten metal-covering defect", where the solidified shell 13 that had been grown was covered with molten metal 12. On the other hand, when the average values of the passing heat flux q in the contact region 16 between the mold 2 and the ingot 11 were 7.5 MW/m$^2$ or more, the heat input into the initial solidified portion 15 was excessive, thus causing the "tearing-off defect", where the thin surface portion of the solidified shell 13 was torn off. The results show that the average values of the passing heat flux q in the contact region 16 between the mold 2 and the ingot 11 are preferably controlled into the range of 5 $MW/m^2<q<7.5$ $MW/m^2$.

Figure 10:
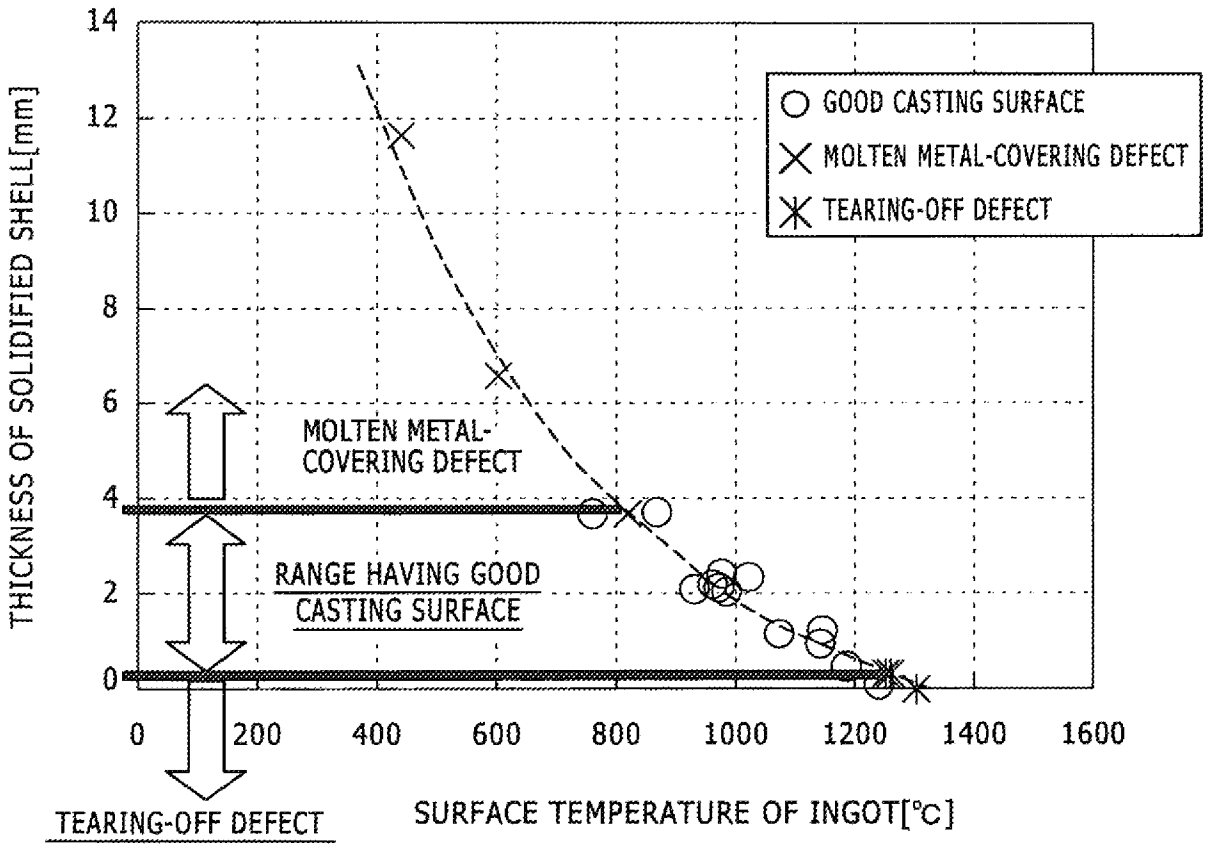
FIG. 10 is a graph showing the relation between surface temperature of an ingot and thickness of a solidified shell.

FIG. 10 is a graph showing the relation between the temperature of the surface portion 11*a* of the ingot 11 and the thickness of the solidified shell 13. When the thickness D of the solidified shell 13 in the contact region 16 between the mold 2 and the ingot 11 was 0.4 mm or less, there was caused the "tearing-off defect", where the surface of the solidified shell 13 was torn off due to lack of strength by not having the sufficient thickness of the solidified shell 13. On the other hand, when the thickness D of the solidified shell 13 in the contact region 16 between the mold 2 and the ingot 11 is 4 mm or more, there was caused the "molten metal-covering defect", where the solidified shell 13 that had been grown (thickened) was covered with the molten metal 12. The results show that the thickness D of the solidified shell 13 in the contact region 16 between the mold 2 and the ingot 11 is preferably controlled into the range of 0.4 mm<D<4 mm.

(Effects)

As described above, in the continuous casting method for a ingot made of titanium or a titanium alloy according to the present embodiment, the thickness of the solidified shell 13 in the contact region 16 is determined by at least either value of; the temperature of the surface portion 11*a* of the ingot 11 in the contact region 16 between the mold 2 and the ingot 11; and the passing heat flux q from the surface portion 11*a* of the ingot 11 to the mold 2 in the contact region 16. Thus, by controlling the temperature of the surface portion 11*a* of the ingot 11 in the contact region 16 and/or the passing heat flux from the surface portion 11*a* of the ingot 11 to the mold 2 in the contact region 16, the thickness of the solidified shell 13 in the contact region 16 is brought into a predetermined range in which defects are not caused on the surface of the ingot 11. Consequently, since the defects on the surface of the ingot 11 can be suppressed form occurring, the ingot 11 having a good casting surface state can be cast.

Further, by controlling the average values of the temperature $T_S$ of the surface portion 11*a* of the ingot 11 in the contact region 16 between the mold 2 and the ingot 11 into the range of 800° C.<$T_S$<1250° C., the defects on the surface of the ingot 11 can be suppressed from occurring.

Further, by controlling the average values of the passing heat flux q from the surface portion 11*a* of the ingot 11 to the mold 2 in the contact region 16 between the mold 2 and the ingot 11 into the range of 5 $MW/m^2<q<7.5$ $MW/m^2$, the defects on the surface of the ingot 11 can be suppressed from occurring.

Further, by controlling the thickness D of the solidified shell 13 in the contact region 16 between the mold 2 and the ingot 11 into the range of 0.4 mm<D<4 mm, there can be suppressed from occurring the "tearing-off defect", where the surface of the solidified shell 13 is torn off due to lack of strength by not having the sufficient thickness of the solidified shell 13 and the "molten metal-covering defect", where the solidified shell 13 that has been grown (thickened) is covered with the molten metal 12.

Further, by subjecting titanium or a titanium alloy to the plasma arc melting, not only titanium but also a titanium alloy can be cast.

(Modifications)

The embodiments of the present invention are described hereinabove, however, it is obvious that the above embodiments solely serve as examples and are not to limit the present invention. The specific structures and the like of the present invention may be modified and designed according to the needs. Further, the actions and effects of the present invention described in the above embodiments are no more than most preferable actions and effects achieved by the present invention, thus the actions and effects of the present invention are not limited to those described in the above embodiments of the present invention.

For example, the present embodiments describe the case where titanium or a titanium alloy is subjected to the plasma arc melting, however, the present invention may be applied to the case where titanium or a titanium alloy is melted by cold hearth melting other than the plasma arc melting, e.g., electron beam heating, induction heating, and laser heating.

Further, the present invention may be applied to the case where a flux layer is interposed between the mold 2 and the ingot 11.

The present application is based on Japanese Patent Application (Japanese Patent Application No. 2013-003916) filed on Jan. 11, 2013, the contents of which are incorporated herein by reference.

EXPLANATION OF REFERENCE NUMERALS

1, 201 Continuous casting apparatus
2, 202 Mold
3 Cold hearth
3*a* Pouring portion
4 Raw material charging apparatus
5 Plasma torch
6 Starting block
7 Plasma torch
11 Ingot
11*a* Surface portion
12 Molten metal
13 Solidified shell
14 Air gap
15 Initial solidified portion
16 Contact region
31 Thermocouples
211 Slab

The invention claimed is:

1. A continuous casting method for continuously casting an ingot made of titanium or a titanium alloy by injecting molten metal having titanium or a titanium alloy melted therein into a bottomless mold and withdrawing the molten metal downward while being solidified, wherein, by controlling temperature of a surface portion of the ingot in a contact region between the mold and the ingot, and/or a passing heat flux from the surface portion of the ingot to the mold in the contact region, thickness of a solidified shell formed by solidifying the molten metal in the contact region is brought into a predetermined range, wherein average values of the temperature Ts of the surface portion of the ingot in the contact region are controlled into the range of 800° C.<$T_S$<1250° C., and wherein the thickness D of the solidified shell in the contact region is controlled into the range of 0.4 mm<D<4 mm, wherein the contact region is limited to a region near a meniscus.

2. The continuous casting method for the ingot made of titanium or a titanium alloy according to claim 1, wherein average values of the passing heat flux from the surface portion of the ingot to the mold in the contact region are controlled into the range of 5 $MW/m^2<q<7.5$ $MW/m^2$.

3. The continuous casting method for the ingot made of titanium or a titanium alloy according to claim 1, wherein the molten metal is prepared by melting the titanium or the titanium alloy by cold hearth melting and is injected into the mold.

4. The continuous casting method for the ingot made of titanium or a titanium alloy according to claim 3, wherein the cold hearth melting is plasma arc melting.

5. A continuous casting method for continuously casting an ingot made of titanium or a titanium alloy by injecting molten metal having titanium or a titanium alloy melted therein into a bottomless mold and withdrawing the molten metal downward while being solidified, wherein, by controlling temperature of a surface portion of the ingot in a contact region between the mold and the ingot, and/or a passing heat flux from the surface portion of the ingot to the mold in the contact region, thickness of a solidified shell formed by solidifying the molten metal in the contact region is brought into a predetermined range, wherein average values of the passing heat flux from the surface portion of the ingot to the mold in the contact region are controlled into the range of $5\ MW/m^2<q<7.5\ MW/m^2$, and wherein the thickness D of the solidified shell in the contact region is controlled into the range of $0.4\ mm<D<4\ mm$, wherein the contact region is limited to a region near a meniscus.

* * * * *